US006390398B1

(12) United States Patent
Wu Huang

(10) Patent No.: US 6,390,398 B1
(45) **Date of Patent: *May 21, 2002**

(54) DEVICE CAPABLE OF SHREDDING PAPER AND SHARPENING PENCIL

(76) Inventor: Li-Ming Wu Huang, 3F, No. 29, Lane 80, Sec. 1, Dwu Hwu S. Rd., Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/557,779

(22) Filed: Apr. 25, 2000

(51) Int. Cl.[7] ..... B02C 18/00
(52) U.S. Cl. ..... 241/100; 241/101.2; 241/236
(58) Field of Search ..... 241/100, 101.2, 241/236, 36

(56) References Cited

U.S. PATENT DOCUMENTS 6,164,573 A * 12/2000 Li-Ming ..... 241/100

* cited by examiner

*Primary Examiner*—Mark Rosenbaum

(74) *Attorney, Agent, or Firm*—Browdy and Neimark, P.L.L.C.

(57) ABSTRACT

A device is designed to shred paper and to sharpen pencil. The device comprises a housing, a paper-shredding tool, a drive apparatus, a link mechanism, a rotation mechanism, and a pencil sharpening tool. The housing is provided with a long hole and a through hole. The paper-shredding tool is mounted in the housing and is corresponding in location to the long hole of the housing. The drive apparatus is mounted in the housing to provide a driving force, which is transmitted via the link mechanism to the paper-shredding tool. The rotation mechanism is mounted in the housing and is connected with the link mechanism. The pencil-sharpening tool is disposed in the rotation mechanism to turn along with the rotation mechanism. The pencil-sharpening tool is corresponding in location to the through hole of the housing.

9 Claims, 8 Drawing Sheets

DEVICE CAPABLE OF SHREDDING PAPER AND SHARPENING PENCIL

FIELD OF THE INVENTION

The present invention relates generally to an office equipment, and more particularly to a device which is designed for shredding paper and sharpening pencil.

BACKGROUND OF THE INVENTION

The conventional paper shredders are not equipped to sharpen a pencil. The conventional pencil sharpeners are not equipped to shred paper. In light of functions of a paper shredder and a pencil sharpener being different, the paper shredder and the pencil sharpener are made independently as two unrelated office equipments which are apt to take up additional office space.

SUMMARY OF THE INVENTION

It is therefore the primary objective of the present invention to provide a two-in-one office equipment capable of shredding paper and sharpening pencil.

It is another objective of the present invention to provide a device which is designed for shredding paper and sharpening pencil and does not take up an extra office space.

The features and the advantages of the present invention will be readily understood upon a thoughtful deliberation of the following detailed description of the present invention with reference to the accompanying drawings.

DETAILED DESCRIPTION OF THE INVENTION

Figure 1:
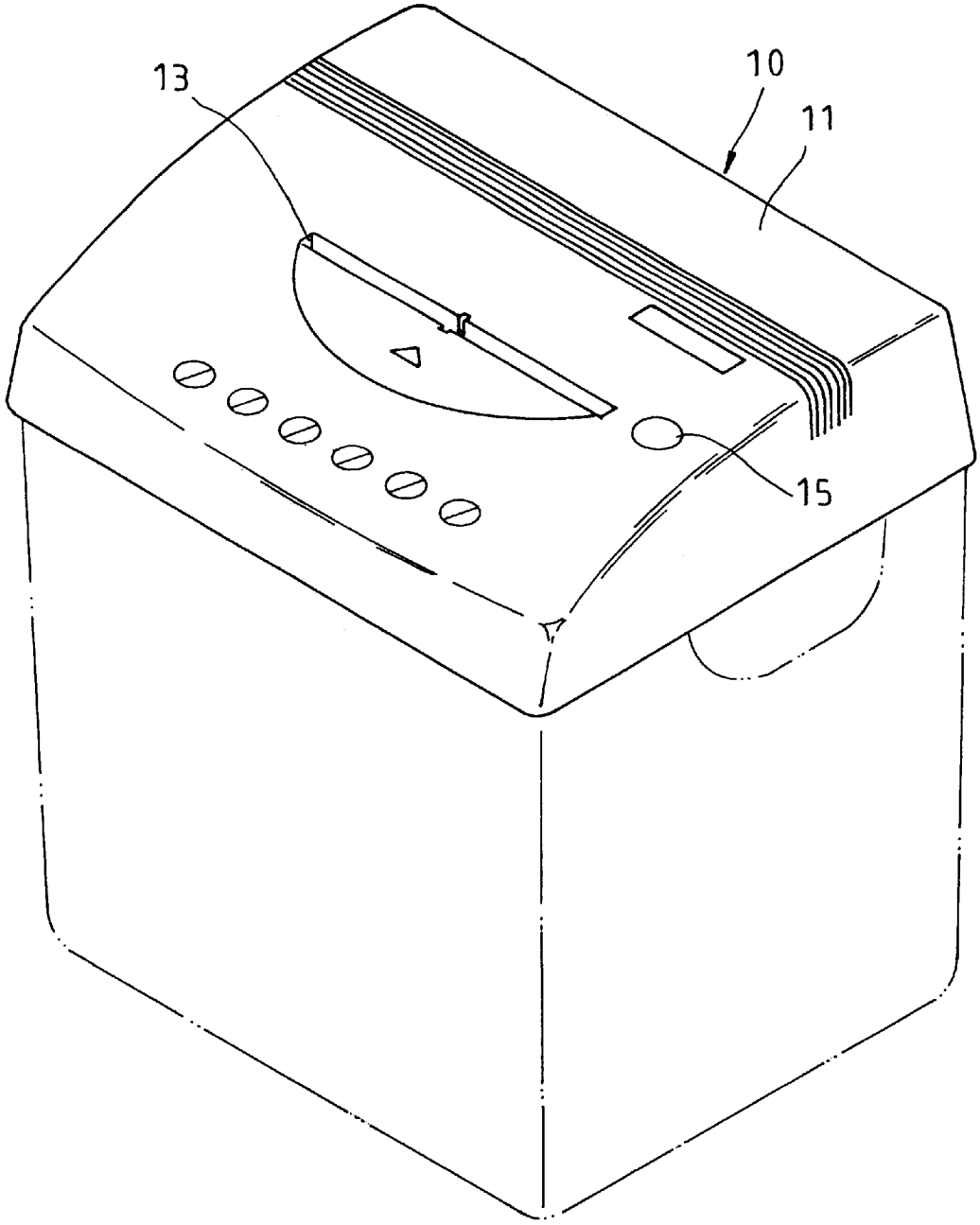
FIG. 1 shows a perspective view of a first preferred embodiment of the present invention.
Figure 2:
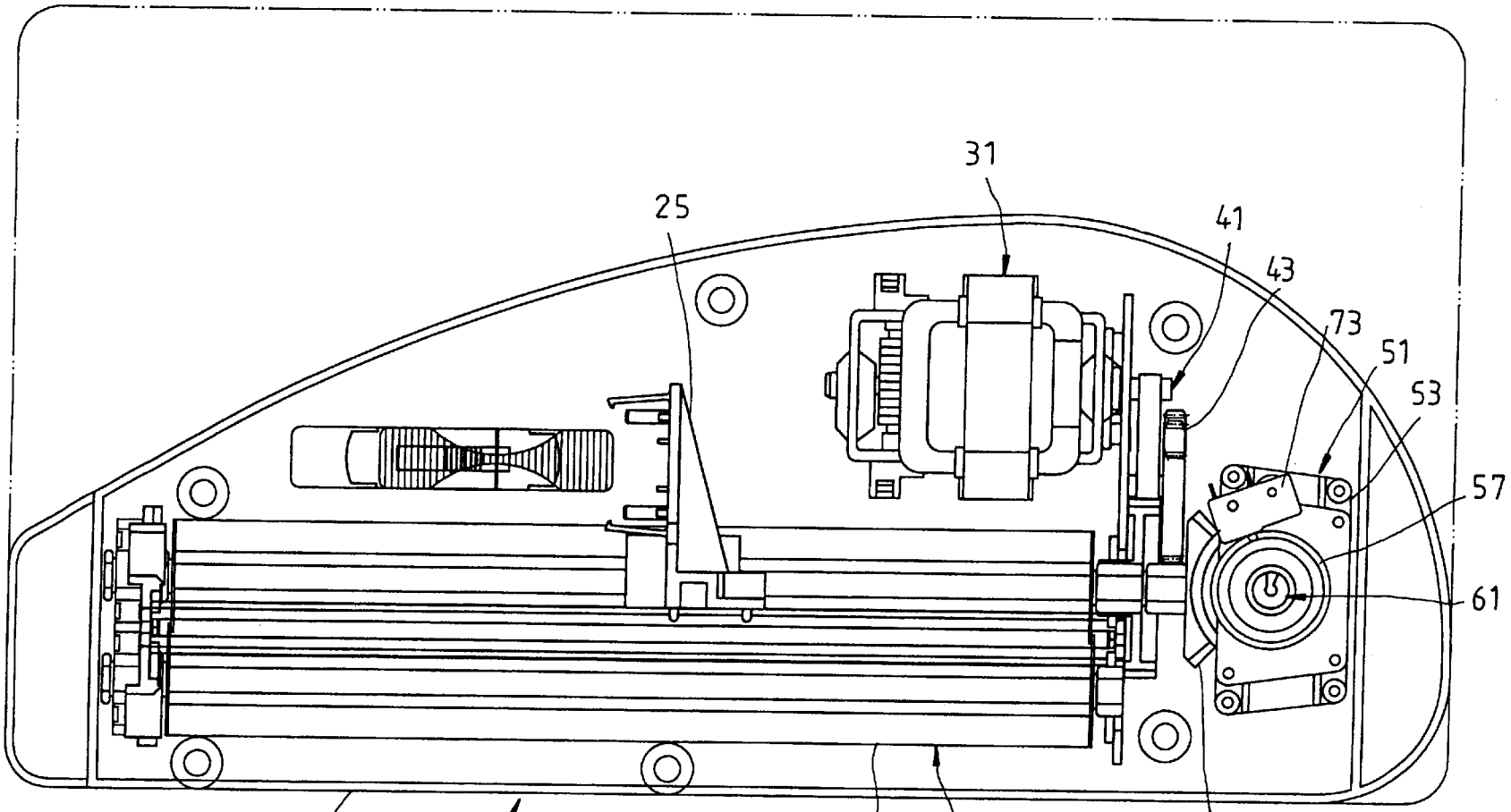
FIG. 2 shows a top sectional view of the first preferred embodiment of the present invention.
Figure 3:
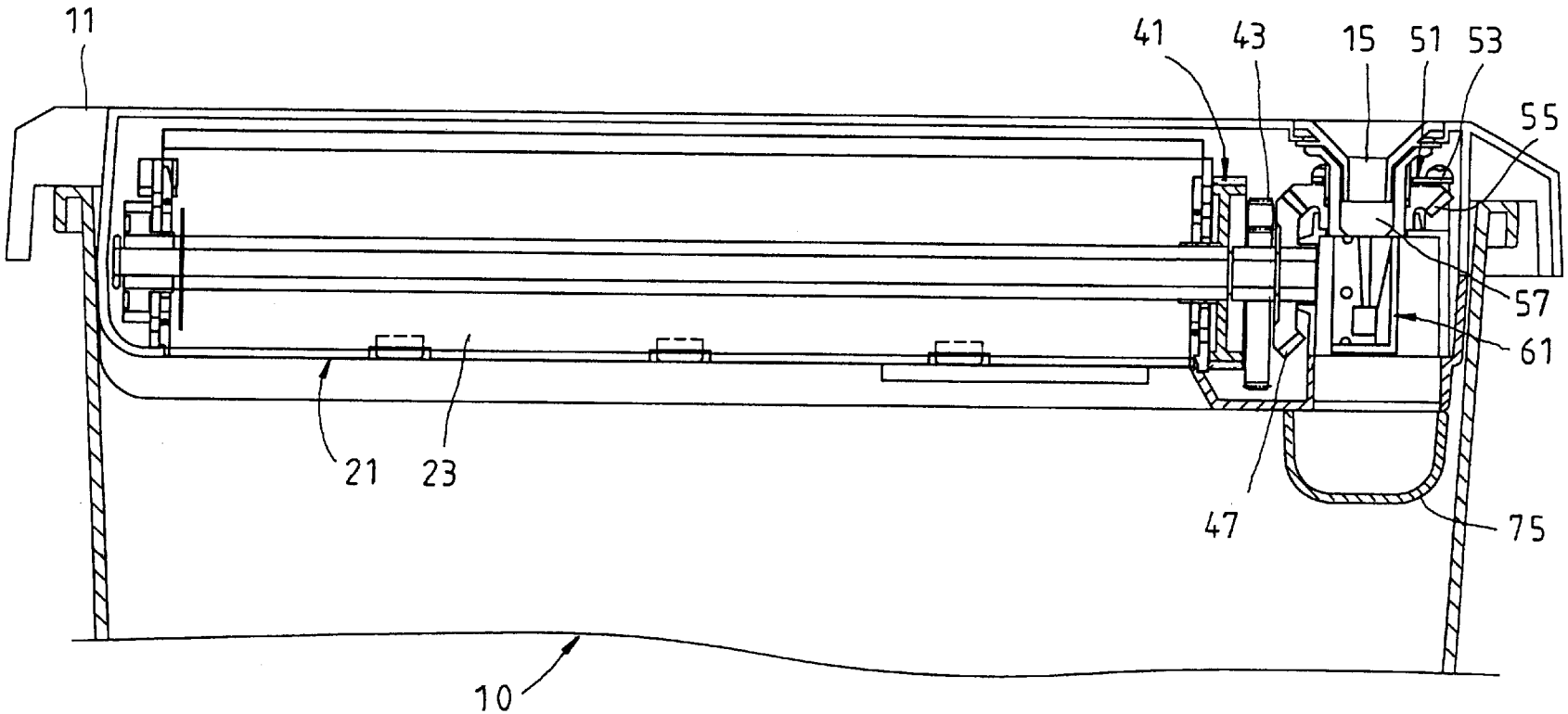
FIG. 3 shows a front sectional view of the first preferred embodiment of the present invention.

As shown in FIGS. 1–4, a device 10 embodied in the present invention is designed for shredding paper and sharpening pencil and is formed of a housing 11, a paper-shredding tool 21, a drive apparatus 31, a link mechanism 41, a rotation mechanism 51, and a pencil sharpening tool 61.

The housing 11 is provided in the top with a long hole 13, and a through hole 15.

The paper-shredding tool 21 is mounted in the housing 11 and is formed of two cutters 23 which are connected with each other and are corresponding in location to the long hole 13 of the housing 11.

The drive apparatus 31 is a motor which is mounted in the housing

The link mechanism 41 is formed of a plurality of gears 43, which are engaged with the drive apparatus 31 and the paper-shredding tool 21 for transmitting the motion from the drive apparatus 31 to the paper-shredding tool 21. The link mechanism 41 is composed of a sector gear 47.

The rotation mechanism 51 comprises a base 53 and a rotating member 55. The base 53 is mounted in the housing 11 and is located next to the link mechanism 41. The rotating member 55 is a sector gear meshing the sector gear 47 of the link mechanism 41 and having a center through hole 57 which is corresponding in location to a through hole 15 of the housing 11. The rotating member 55 is pivoted to the base 53 such that the rotating member 55 is driven by the drive apparatus 31 to turn.

The pencil sharpening tool 61 is fixed under the rotating member 55 and is actuated by the rotating member 55. The pencil sharpening tool 61 is corresponding in location to the through hole 15 of the housing 11. A pencil to be sharpened is inserted into the device 10 via the through hole 15.

The device 10 of the present invention further comprises a microswitch 73 and a pencil-dust collector 75. The microswitch 73 is disposed in the housing 11 and is contiguous to the through hole 15. As a pencil is inserted into the device 10 via the through hole 15, the microswitch 73 is touched by the pencil such that the drive device 31 is started by the microswitch 73. The pencil-dust collector 75 is disposed under the base 53, the pencil sharpening tool 61, and the microswitch 73 for collecting the pencil dust.

Figure 5:
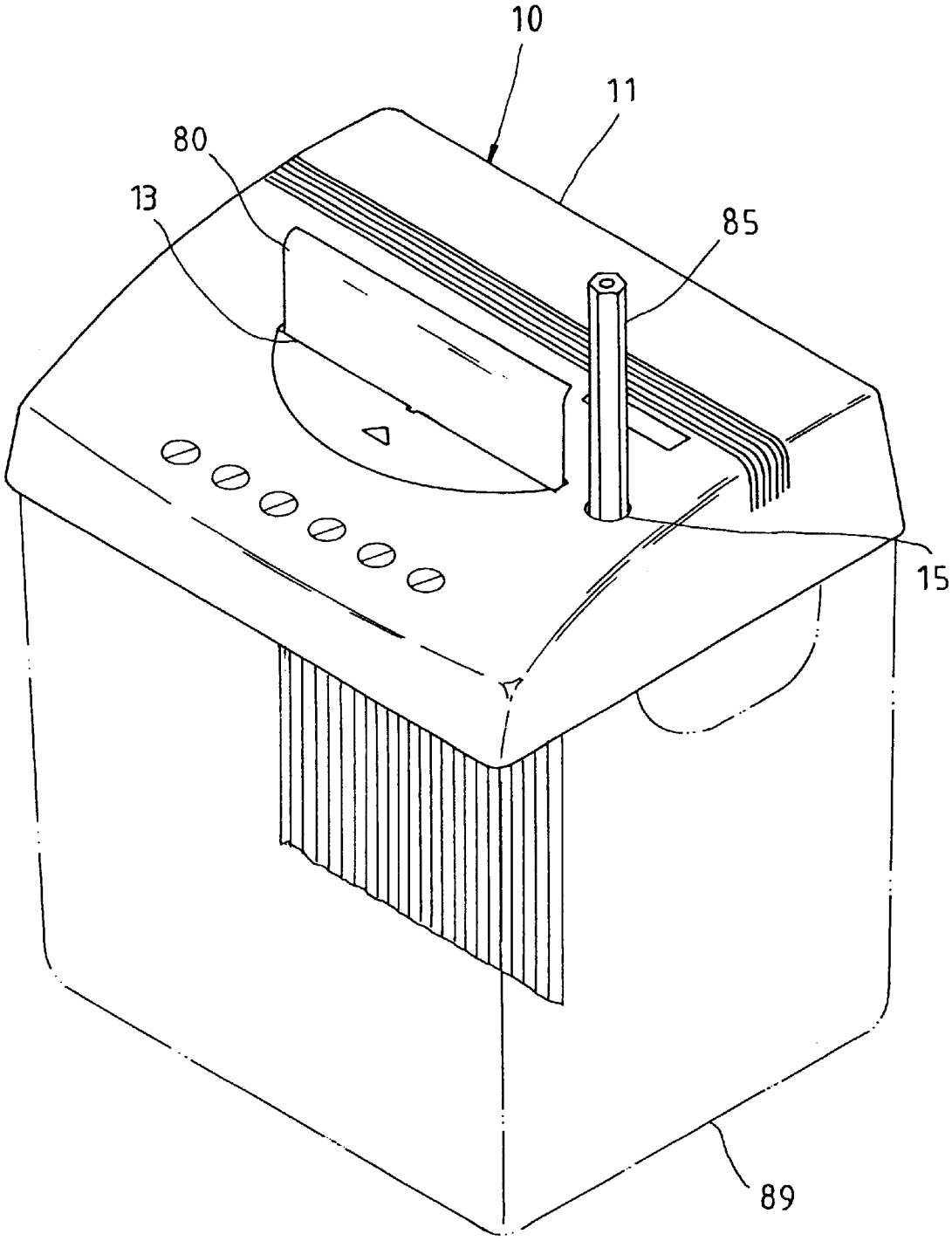
FIG. 5 shows a schematic view of the first preferred embodiment of the present invention in operation.

A illustrated in FIG. 5, a paper sheet 80 is inserted into the device 10 via the long hole 13 of the housing 11 such that the paper sheet 80 is torn into narrow strips in order to destroy it. As soon as the paper sheet 80 is inserted into the long hole 13, the microswitch 25 is triggered to start the drive apparatus 31. The driving force of the drive apparatus 31 is transmitted via the link mechanism 41 to the paper-shredding tool 21 by which the paper sheet 80 is cut into fragments.

Figure 6:
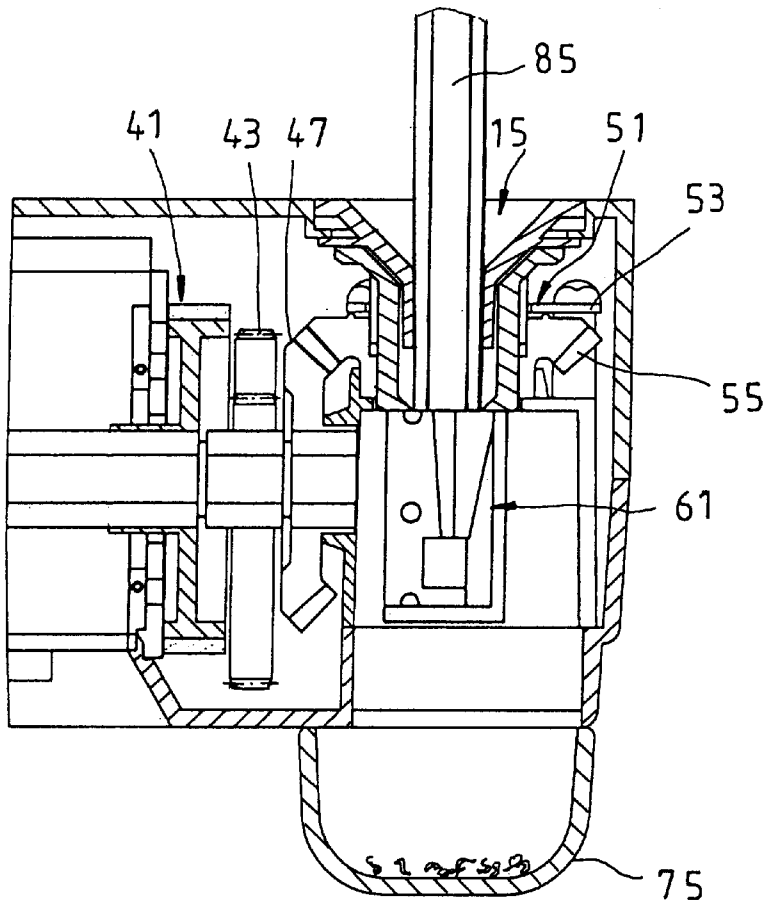
FIG. 6 shows another schematic view of the first preferred embodiment of the present invention in operation.
Figure 4:
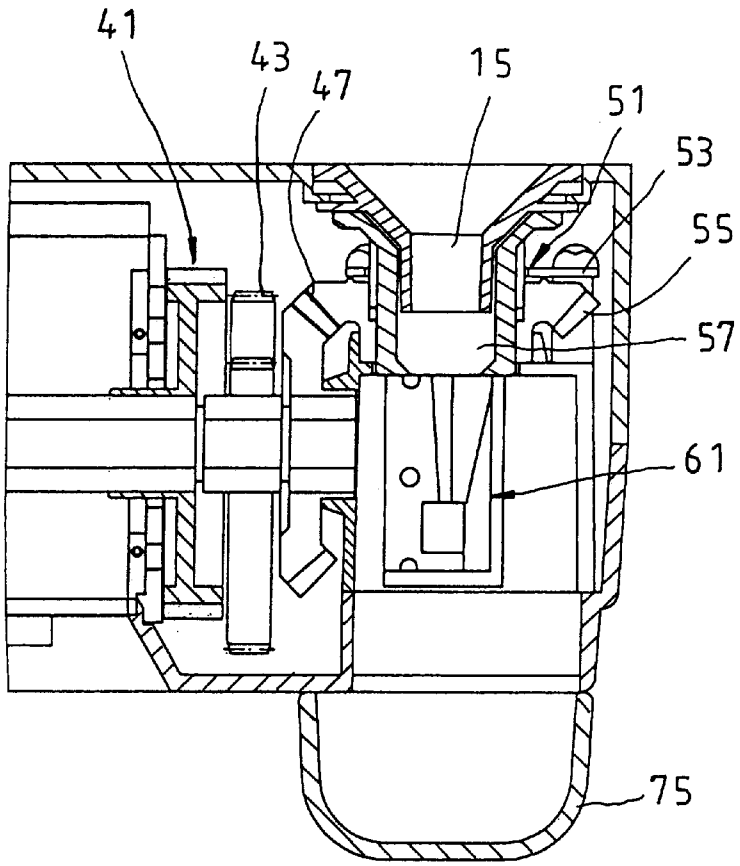
FIG. 4 shows a partial enlarged view of the first preferred embodiment of the present invention.

As illustrated in FIG. 6, a pencil 85 is inserted into the device 10 via the through hole 15 of the housing 11. As soon as the pencil 85 is inserted into the through hole 15, the microswitch 73 is triggered to start the drive apparatus 31. The driving force of the drive apparatus 31 is transmitted via the sector gear 47 of the link mechanism 41 to the rotating member 55 (sector gear) of the rotation mechanism 51. As a result, the pencil sharpening tool 61 is actuated to bring about the sharpening of the pencil 85. The pencil dust is gathered by the pencil-dust collector 75.

The paper shredding operation and the pencil sharpening operation can be carried out simultaneously by the device 10 of the present invention.

Figure 7:
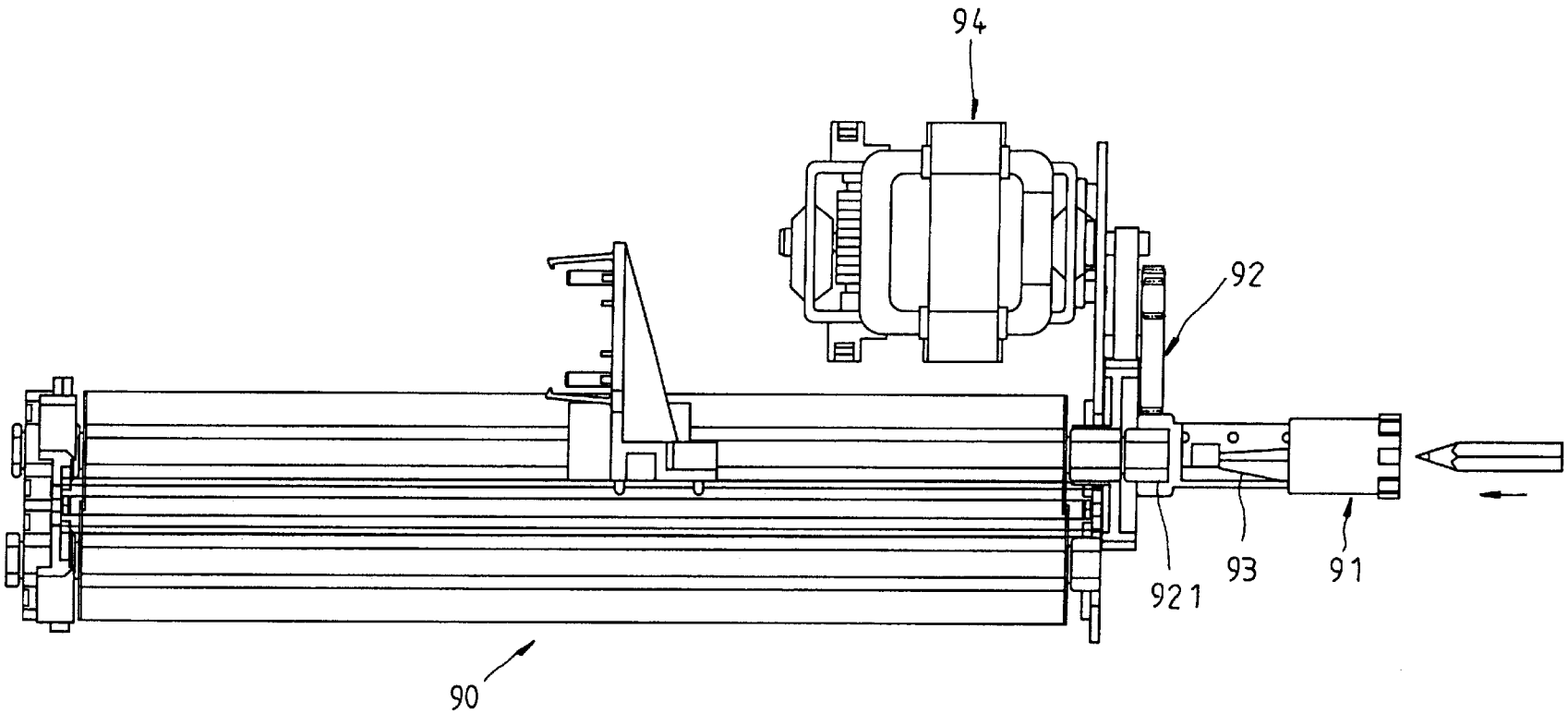
FIG. 7 shows a top sectional view of a second preferred embodiment of the present invention.

As shown in FIG. 7, a device 90 of the second preferred embodiment of the present invention is basically similar in construction to the device 10 described above, with the difference being that the device 90 comprises a rotation mechanism 91 which is a rotating base connected with a gear shaft 921 of a link mechanism 92. The pencil sharpening tool 93 is disposed in the rotating base 91. As the pencil is inserted into the device 90 via the through hole of the housing, the pencil is guided into the pencil sharpening tool 93 such that the pencil is sharpened by the pencil sharpening tool 93 which turns along with the rotating base 91.

Figure 8:
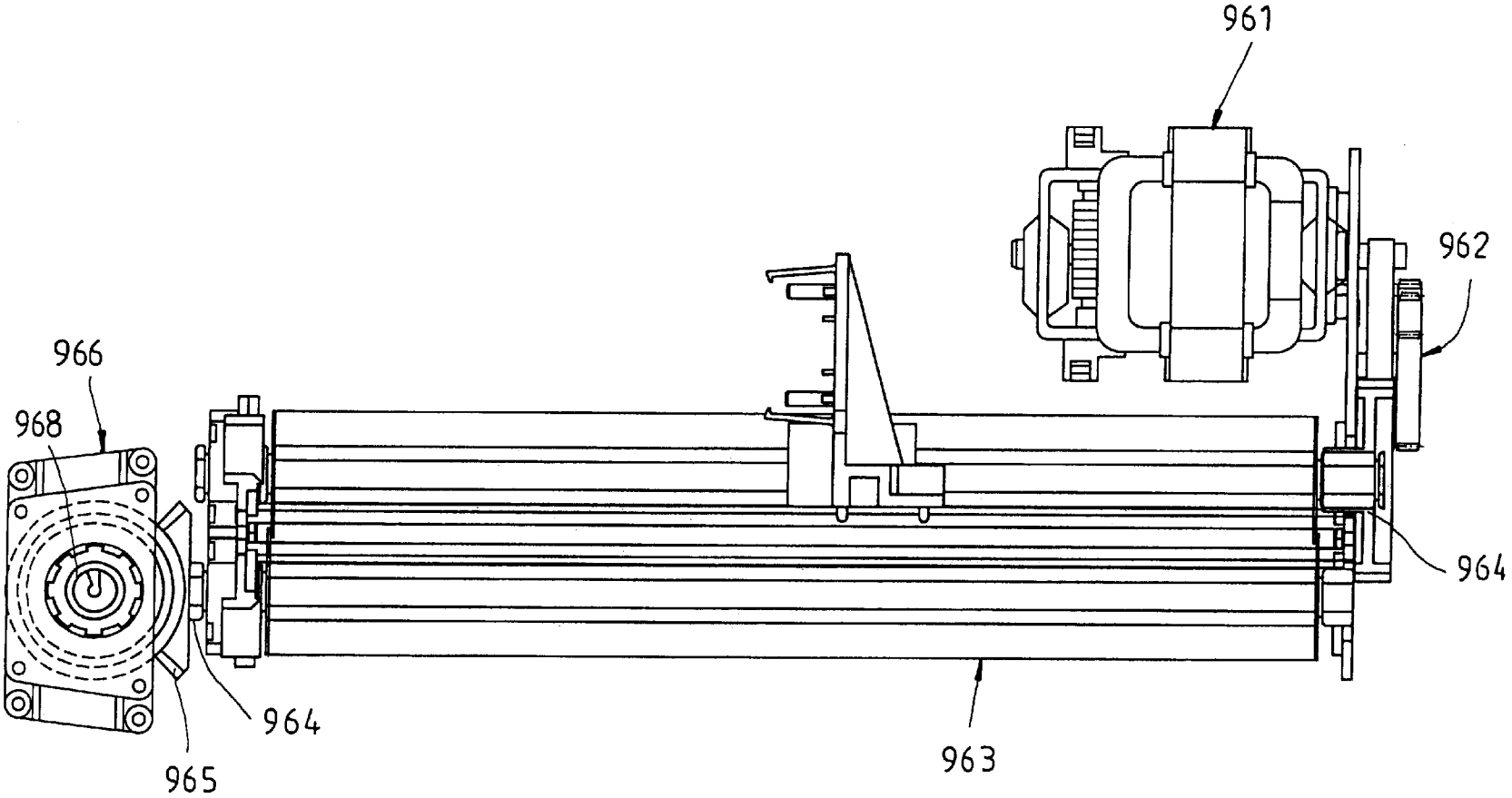
FIG. 8 shows a sectional view of the second preferred embodiment of the present invention.

As shown in FIG. 8, the drive apparatus 961 and the link mechanism 962 are mounted on one end of a shaft rod 964 of the paper-shredding tool 963. The sector gear 965, the rotation mechanism 966, and the pencil sharpening tool 968 are mounted on other end of the shaft rod 964. As the paper-shredding tool 963 is in operation, the sector gear 965 is actuated to turn so as to actuate the pencil sharpening tool 968 to turn to sharpen the pencil.

Figure 9:
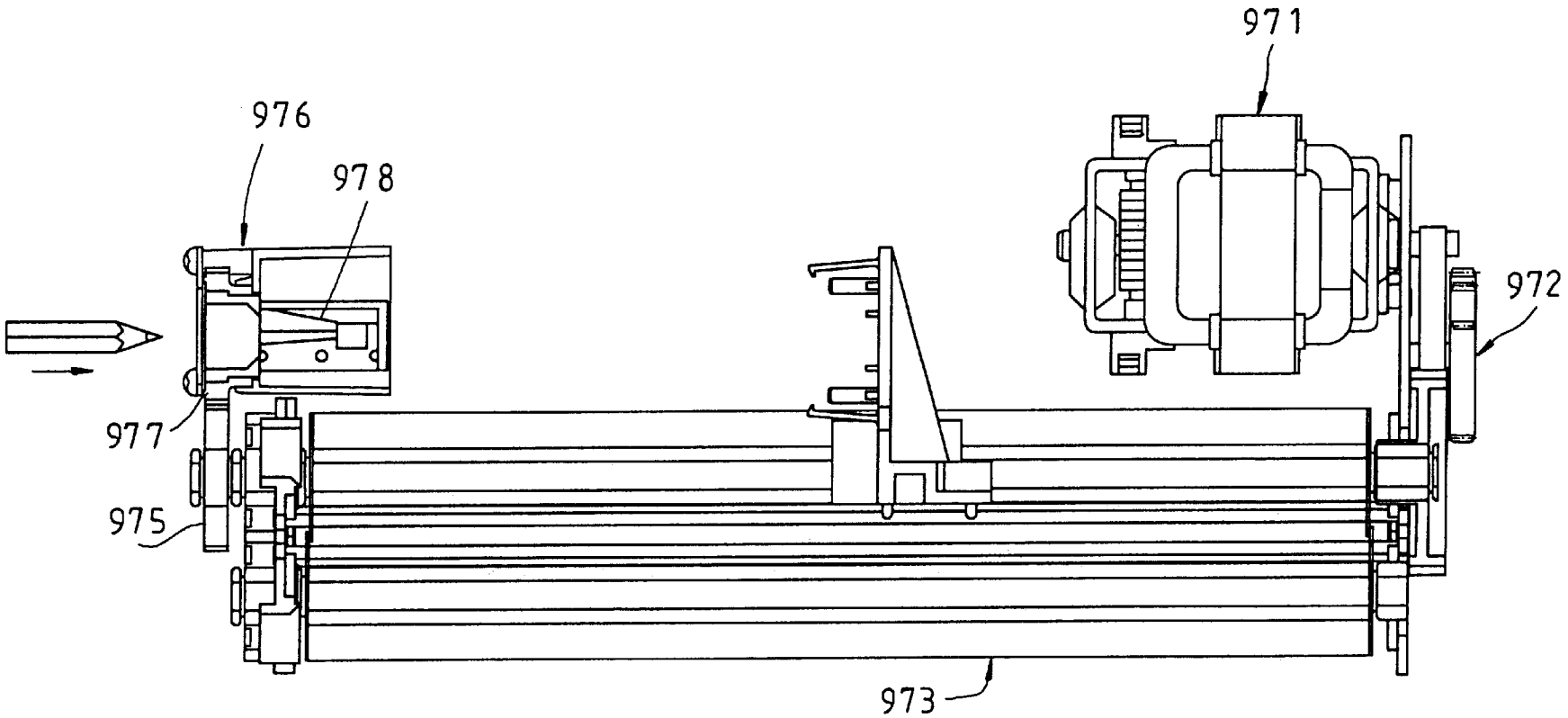
FIG. 9 shows another sectional view of the second preferred embodiment of the present invention.

As shown in FIG. 9, the drive apparatus 971, and the link mechanism 972 are mounted on one end of the shaft rod 974 of the paper-shredding tool 963. A gear 975 is mounted on other end of the shaft rod 974. A gear 977 of the rotation mechanism 976 is engaged with the gear 975 for actuating the pencil sharpening tool 978. The through hole must be located in the lateral part of the housing. As a result, the pencil must be inserted into the device 90 from the lateral part of the housing.

As shown in FIGS. 8 and 9, the rotation mechanism and the pencil sharpening tool of the present invention are not confined to a fixed position, as long as they can be conveniently connected with the drive apparatus.

The microswitch 73 may be replaced by a manual switch. The paper dust collector 75 may be replaced by a paper dust collector 89 which is detachably fastened to the underside of the device 90.

What is claimed is:

1. A device for shredding paper and sharpening pencil, said device comprising:

a housing provided with a long hole and a through hole;

a paper-shredding tool mounted in said housing such that said paper-shredding tool is corresponding in location to said long hole of said housing;

a drive apparatus mounted in said housing as a source of driving force;

a link mechanism connected with said drive apparatus and said paper-shredding tool for transmitting the driving force to said paper-shredding tool from said drive apparatus;

a rotation mechanism mounted in said housing; and a pencil-sharpening tool mounted in said rotation mechanism for sharpening a pencil which is inserted via said through hole of said housing.

2. The device as defined in claim 1, wherein said rotation mechanism comprises a base and a rotating member pivoted with said base and connected with said link mechanism.

3. The device as defined in claim 2, wherein said link mechanism is formed of a plurality of gears engaging one another; wherein said rotating member is a gear, which is engaged with one of said gears of said link mechanism; wherein said rotation mechanism is provided with a through hole corresponding in location to said through hole of said housing.

4. The device as defined in claim 3, wherein said pencil-sharpening tool is mounted under said rotating member.

5. The device as defined in claim 3, wherein said rotation mechanism has a sector gear; wherein said rotating member of said rotation mechanism is a sector gear which is engaged with said sector gear of said rotation mechanism.

6. The device as defined in claim 1, wherein said link mechanism is formed of a plurality of gears engaging one another; wherein said rotation mechanism is a rotating base which is connected with a shaft of one of said gears of said link mechanism; wherein said pencil-sharpening tool is disposed in said rotating base such that said pencil-sharpening tool turns along with said rotating base.

7. The device as defined in claim 1, wherein said rotation mechanism is a rotating base which is connected with a shaft rod of said paper-shredding tool; wherein said pencil-sharpening tool is disposed in said rotating base such that said pencil-sharpening tool turns along with said rotating base.

8. The device as defined in claim 1 further comprising a microswitch mounted in said housing such that said microswitch is corresponding in location to said through hole of said housing, and that said microswitch is triggered by a pencil which is inserted into said through hole of said housing.

9. The device as defined in claim 1 further comprising a dust collector which is detachably mounted under said housing and is located right under said pencil-sharpening tool.

* * * * *